US006698857B2

(12) United States Patent
Torgerson et al.

(10) Patent No.: US 6,698,857 B2
(45) Date of Patent: Mar. 2, 2004

(54) METHOD AND APPARATUS FOR TRANSFERRING INFORMATION TO A PRINTHEAD

(75) Inventors: Joseph M. Torgerson, Philomath, OR (US); Bruce Cowger, Corvallis, OR (US); David M. Hurst, Corvallis, OR (US); Mark H. MacKenzie, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/430,950

(22) Filed: May 7, 2003

(65) Prior Publication Data

US 2003/0197748 A1 Oct. 23, 2003

Related U.S. Application Data

(63) Continuation of application No. 09/702,267, filed on Oct. 30, 2000, now Pat. No. 6,582,042.

(51) Int. Cl.[7] ..... B41J 29/38; B41J 2/05

(52) U.S. Cl. ..... 347/12; 347/57; 347/58

(58) Field of Search ..... 347/12, 56–59

(56) References Cited

U.S. PATENT DOCUMENTS

| | | | | |
|---|---|---|---|---|
| 5,541,629 A | | 7/1996 | Saunders et al. | |
| 5,604,519 A | | 2/1997 | Keefe et al. | |
| 5,644,342 A | | 7/1997 | Argyres | |
| 5,984,455 A | | 11/1999 | Anderson | |
| 6,076,910 A | * | 6/2000 | Anderson | 347/12 |
| 6,102,515 A | | 8/2000 | Edwards et al. | |
| 6,176,569 B1 | | 1/2001 | Anderson et al. | |
| 6,190,000 B1 | | 2/2001 | Krouss et al. | |
| 6,286,922 B1 | | 9/2001 | Kondou | |
| 6,286,924 B1 | | 9/2001 | Ahne et al. | |
| 6,299,292 B1 | | 10/2001 | Edwards | |

FOREIGN PATENT DOCUMENTS

| | | |
|---|---|---|
| EP | 0873869 A2 | 10/1998 |
| EP | 0914948 A2 | 5/1999 |
| WO | WO 01/72523 | 10/2001 |

* cited by examiner

*Primary Examiner*—Stephen D. Meier
*Assistant Examiner*—Alfred Dudding
(74) *Attorney, Agent, or Firm*—Kevin B. Sullivan

(57) ABSTRACT

The present disclosure relates to an inkjet printing system that includes an inkjet printhead having a plurality of electrical contacts. The plurality of electrical contacts include address contacts and enable contacts for enabling drop generators and drive current contacts for providing drive current to enable drop generators for selectively ejecting ink therefrom. The printing system includes a printing device having a plurality of electrical contacts including address contacts, enable contacts and drive current contacts. The plurality of electrical contacts are configured to establish electrical contact with corresponding electrical contacts on the inkjet printhead upon insertion of the inkjet printhead into the printing device. The printing device provides periodic address signals and enable signals to the address and enable contacts one the printhead. In addition, the printing device selectively applies drive current to accomplish forming images on print media.

20 Claims, 10 Drawing Sheets

METHOD AND APPARATUS FOR TRANSFERRING INFORMATION TO A PRINTHEAD

CROSS REFERENCE TO RELATED APPLICATION(S)

This is a Continuation of application Ser. No. 09/702,267, filed on Oct. 30, 2000, now U.S. Pat. No. 6,582,042 which is hereby incorporated by reference herein.

BACKGROUND OF THE INVENTION

This invention relates to inkjet printing devices, and more particularly to an inkjet printing device that includes a printhead portion that receives drop activation signals for selectively ejecting ink.

Inkjet printing systems frequently make use of an inkjet printhead mounted to a carriage which is moved back and forth across print media such as paper. As the printhead is moved across the print media, a control device selectively activates each of a plurality of drop generators within the printhead to eject or deposit ink droplets onto the print media to form images and text characters. An ink supply that is either carried with the printhead or remote from the printhead provides ink for replenishing the plurality of drop generators.

Individual drop generators are selectively activated by the use of an activation signal that is provided by the printing system to the printhead. In the case of thermal inkjet printing, each drop generator is activated by passing an electric current through a resistive element such as a resistor. In response to the electric current the resistor produces heat, that in turn, heats ink in a vaporization chamber adjacent the resistor. Once the ink reaches vaporization, a rapidly expanding vapor front forces ink within the vaporization chamber through an adjacent orifice or nozzle. Ink droplets ejected from the nozzles are deposited on print media to accomplish printing.

The electric current is frequently provided to individual resistors or drop generators by a switching device such as a field effect transistor (FET). The switching device is activated by a control signal that is provided to the control terminal of the switching device. Once activated the switching device enables the electric current to pass to the selected resistor. The electric current or drive current provided to each resistor is sometimes referred to as a drive current signal. The control signal for selectively activating the switching device associated with each resistor is sometimes referred to as an address signal.

In one previously used arrangement, a switching transistor is connected in series with each resistor. When active, the switching transistor allows a drive current to pass through each of the resistor and switching transistor. The resistor and switching transistor together form a drop generator. A plurality of these drop generators are then arranged in a logical two-dimensional array of drop generators having rows and columns. Each column of drop generators in the array are connected to a different source of drive current and with each drop generator within each column connected in a parallel connection between the source of drive current for that column. Each row of drop generators within the array is connected to a different address signal with each drop generator within each row connected to a common source of address signals for that row of drop generators. In this manner, any individual drop generator within the two-dimensional array of drop generators can be individually activated by activating the address signal corresponding to the drop generator of row and providing drive current from the source of drive current associated with the drop generator column. In this manner, the number of electrical interconnects required for the printhead is greatly reduced over providing drive and control signals for each individual drop generator associated with the printhead.

While the row and column addressing scheme previously discussed is capable of being implemented in relatively simple and relatively inexpensive technology tending to reduce printhead manufacturing costs, this technique suffers from the disadvantage of requiring relatively large number of bond pads for printheads having large numbers of drop generators. For printheads having in excess of three hundred drop generators, a number of bond pads tends to become a limiting factor when attempting to minimize the die size.

Another technique that has been previously been used makes use of transferring activation information to the printhead in a serial format. This drop generator activation information is rearranged using shift registers so that the proper drop generators can be activated. This technique, while greatly reducing the number of electrical interconnects, tends to require various logic functions as well as static memory elements. Printheads having various logic functions and memory elements require suitable technologies such as CMOS technology and tend to require a constant power supply. Printheads formed using CMOS technology tend to be more costly to manufacture than printheads using NMOS technology. The CMOS manufacturing process is a more complex manufacturing process than the NMOS manufacturing process that requires more masking steps that tend to increase the costs of the printhead. In addition, the requirement of a constant power supply tends to increase the cost of the printing device that must supply this constant power supply voltage to the printhead.

There is an ever present need for inkjet printheads that have fewer electrical interconnects between the printhead and the printing device thereby tending to reduce the overall costs of the printing system as well as the printhead itself. These printheads should be capable of being manufactured using a relatively inexpensive manufacturing technology that allows the printheads to be manufactured using high volume manufacturing techniques and have relatively low manufacturing costs. These printheads should allow information to be transferred between the printing device and the printhead in a reliable manner thereby allowing high print quality as well as reliable operation. Finally, these printheads should be capable of supporting large numbers of drop generators to provide printing systems that are capable of providing high print rates.

SUMMARY OF THE INVENTION

One aspect of the present invention is an inkjet printing system that includes an inkjet printhead having a plurality of electrical contacts. The plurality of electrical contacts include address contacts and enable contacts for enabling drop generators and drive current contacts for providing drive current to enable drop generators for selectively ejecting ink therefrom. The printing system includes a printing device having a plurality of electrical contacts including address contacts, enable contacts and drive current contacts. The plurality of electrical contacts are configured to establish electrical contact with corresponding electrical contacts on the inkjet printhead upon insertion of the inkjet printhead into the printing device. The printing device provides periodic address signals and enable signals to the address and enable contacts one the printhead. In addition, the printing device selectively applies drive current to accomplish forming images on print media.

Another aspect of the present invention is an inkjet printhead responsive to enable and drive current signals for dispensing ink. The inkjet printhead includes an energy storage device for storing energy. Also included is an energy charging device responsive to a first enable signal for storing energy in the energy storage device. The inkjet printhead further includes an energy discharging device responsive to a second enable signal for discharging energy in the energy storage device. A drop generating device is included for dispensing ink from the inkjet printhead upon activation. The drop generating device is activated by a drive current signal active and energy stored in the energy storage device being greater than a threshold energy level.

Yet another aspect of the present invention is an inkjet printhead having a plurality of drop generators with each drop generator of the plurality of drop generators responsive to an activation signal and a drive current for selectively dispensing ink therefrom. The inkjet printhead includes a plurality of groups of drop generators for depositing ink on media Each of the plurality of groups of drop generators are capable of activation once over a printhead activation cycle. The printhead activation cycle is subdivided into a plurality of timeslots with each of the plurality of groups of drop generators having a corresponding timeslot associated therewith. The activation signal is active in the corresponding timeslot before drive current is provided. In addition, the activation signal is active for a duration that is less than a duration drive current is provided. Each drop generator within each group of drop generators is configured so that when activated the drop generator is active for the duration that drive current is provided.

DETAILED DESCRIPTION OF THE PREFERRED EMBODIMENT

Figure 1:
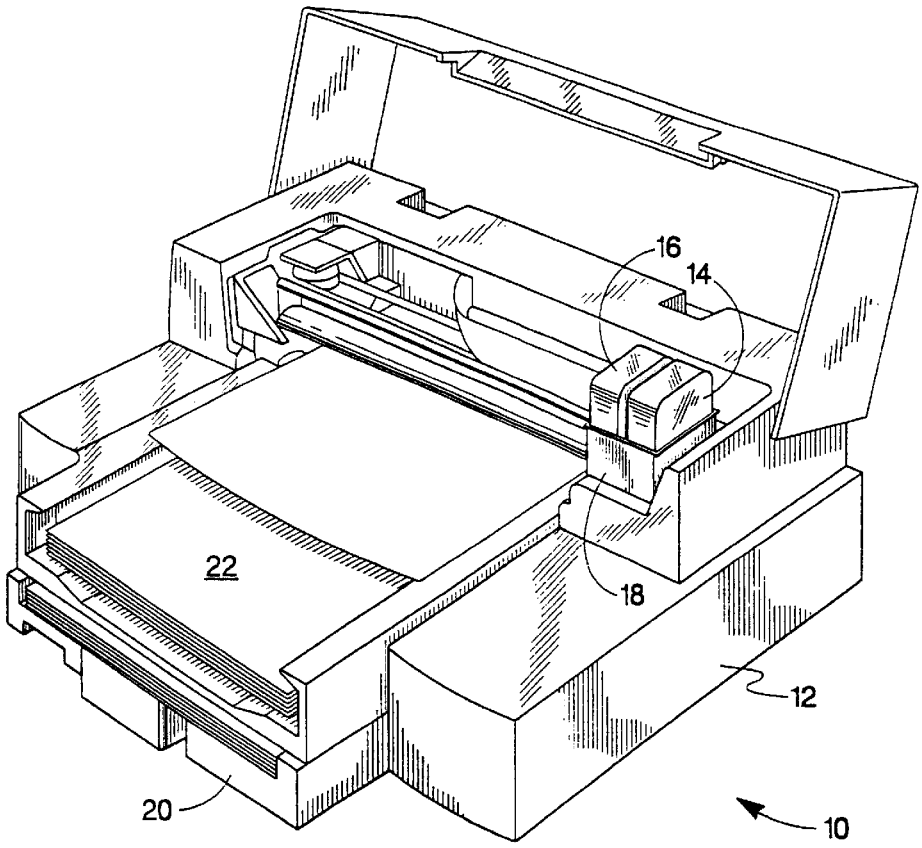
FIG. 1 depicts a printing system of the present invention that incorporates an inkjet print cartridge of the present invention for accomplishing printing on print media shown in a top perspective view.

FIG. 1 is a perspective view of one exemplary embodiment of an inkjet printing system 10 of the present invention shown with its cover open. The inkjet printing system 10 includes a printer portion 12 having at least one print cartridge 14 and 16 installed in a scanning carriage 18. The printing portion 12 includes a media tray 20 for receiving media 22. As the print media 22 is stepped through a print zone, the scanning carriage 18 moves the print cartridges 14 and 16 across the print media. The printer portion 12 selectively activates drop generators within a printhead portion (not shown) associated with each of the print cartridges 14 and 16 to deposit ink on the print media to thereby accomplish printing.

An important aspect of the present invention is a method for which the printer portion 12 transfers drop generator activation information to the print cartridges 14 and 16. This drop generator activation information is used by the printhead portion to activate drop generators as the print cartridges 14 and 16 are moved relative to the print media Another aspect of the present invention is the printhead portion that makes use of the information provided by the printer portion 12. The method and apparatus of the present invention allows information to be passed between the printer portion 12 and the printhead with relatively few interconnects thereby tending to reduce the size of the printhead. In addition the method and apparatus of the present invention allows the printhead to be implemented without requiring clocked storage elements or complex logic functions thereby reducing the manufacturing costs of the printhead. The method and apparatus of the present invention will be discussed in more detail with respect to FIGS. 3–11.

Figure 2:
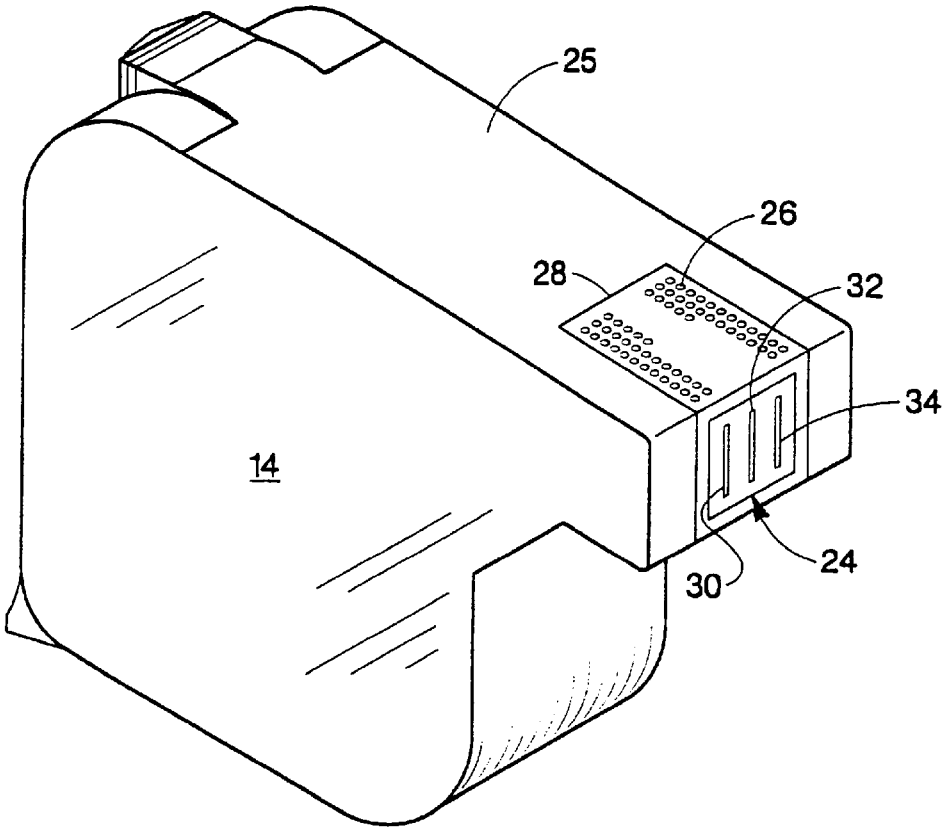
FIG. 2 depicts the inkjet print cartridge shown in FIG. 1 in isolation and viewed from a bottom perspective view.

FIG. 2 depicts a bottom perspective view of one preferred embodiment of the print cartridge 14 shown in FIG. 1. In the preferred embodiment, the cartridge 14 is a 3 color cartridge containing cyan, magenta, and yellow inks. In this preferred embodiment, a separate print cartridge 16 is provided for black ink. The present invention will herein be described with respect to this preferred embodiment by way of example only. There are numerous other configurations in which the method and apparatus of the present invention is also suitable. For example, the present invention is also suited to configurations wherein the printing system contains separate print cartridges for each color of ink used in printing. Alternatively, the present invention is applicable to printing systems wherein more than 4 ink colors are used such as in high-fidelity printing wherein 6 or more ink colors are used. Finally, the present invention is applicable to various types of print cartridges such as print cartridges which include an ink reservoir as shown in FIG. 2, or for print cartridges which are replenished with ink from a remote source of ink, either continuously or intermittently.

The ink cartridge 14 shown in FIG. 2 includes a printhead portion 24 that is responsive to activation signals from the printing system 12 for selectively depositing ink on media 22. In the preferred embodiment, the printhead 24 is defined on a substrate such as silicon. The printhead 24 is mounted to a cartridge body 25. The print cartridge 14 includes a plurality of electrical contacts 26 that are disposed and arranged on the cartridge body 25 so that when properly inserted into the scanning carriage, electrical contact is established between corresponding electrical contacts (not shown) associated with the printer portion 12. Each of the electrical contacts 26 is electrically connected to the printhead 24 by each of a plurality of electrical conductors (not shown). In this manner, activation signals from the printer portion 12 are provided to the inkjet printhead 24.

In the preferred embodiment the electrical contacts 26 are defined in a flexible circuit 28. The flexible circuit 28 includes an insulating material such as polyimide and a conductive material such as copper. Conductors are defined within the flexible circuit to electrically connect each of the electrical contacts 26 to electrical contacts defined on the printhead 24. The printhead 24 is mounted and electrically connected to the flexible circuit 28 using a suitable technique such as tape automated bonding CMAB).

In the exemplary embodiment shown in FIG. 2, the print cartridge is a 3 color cartridge containing yellow, magenta, and cyan inks within a corresponding reservoir portion. The printhead 24 includes drop ejection portions 30, 32 and 34 for ejecting ink corresponding, respectively, to yellow, magenta, and cyan inks. The electrical contacts 26 include electrical contacts associated with activation signals for each of the yellow, magenta, and cyan drop generators 30, 32, 34, respectively.

In the preferred embodiment, the black ink cartridge 16 shown in FIG. 1 is similar to the color cartridge 14 shown in FIG. 2 except the black cartridge makes use of two drop ejection portions instead of three shown on the color cartridge 14. The method and apparatus of the present invention will be discussed herein with respect to the black cartridge 16. However, the method and apparatus of the present invention is applicable to the color cartridge 14 as well.

Figure 3:
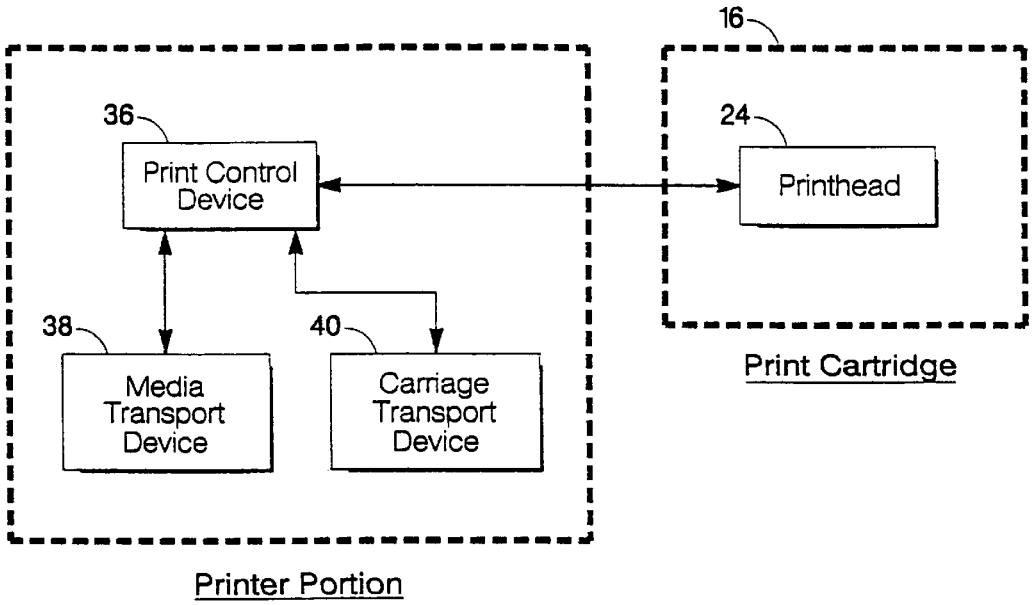
FIG. 3 is a simplified block diagram of the printing system shown in FIG. 1 that includes a printer portion and a printhead portion.

FIG. 3 depicts a simplified electrical block diagram of the printer portion 12 and one of the print cartridges 16. The printer portion 12 includes a print control device 36, a media transport device 38 and a carriage transport device 40. The print control device 36 provides control signals to the media transport device 38 to pass the media 22 through a print zone whereupon ink is deposited on the print media 22. In addition, the print control device 36 provides control signals for selectively moving the scanning carriage 18 across the media 22, thereby defining a print zone. As the media 22 is stepped past the printhead 24 or through the print zone the scanning carriage 18 is scanned across the print media 22. While the printhead 24 is scanned the print control device 36 provides activation signals to the printhead 24 to selectively deposit ink on print media to accomplish printing. Although, the printing system 10 is described herein as having the printhead 24 disposed in a scanning carriage there are other printing system 10 arrangements as well. These other arrangements involve other arrangements of achieving relative movement between the printhead and media such as having a fixed printhead portion and moving the media past the printhead or having fixed media and moving the printhead past the fixed media.

FIG. 3 is simplified to show only a single print cartridge 16. In general, the print control device 36 is electrically connected to each of the print cartridges 14 and 16. The print control device 36 provides activation signals to selectively deposit ink corresponding to each of the ink colors to be printed.

Figure 4:
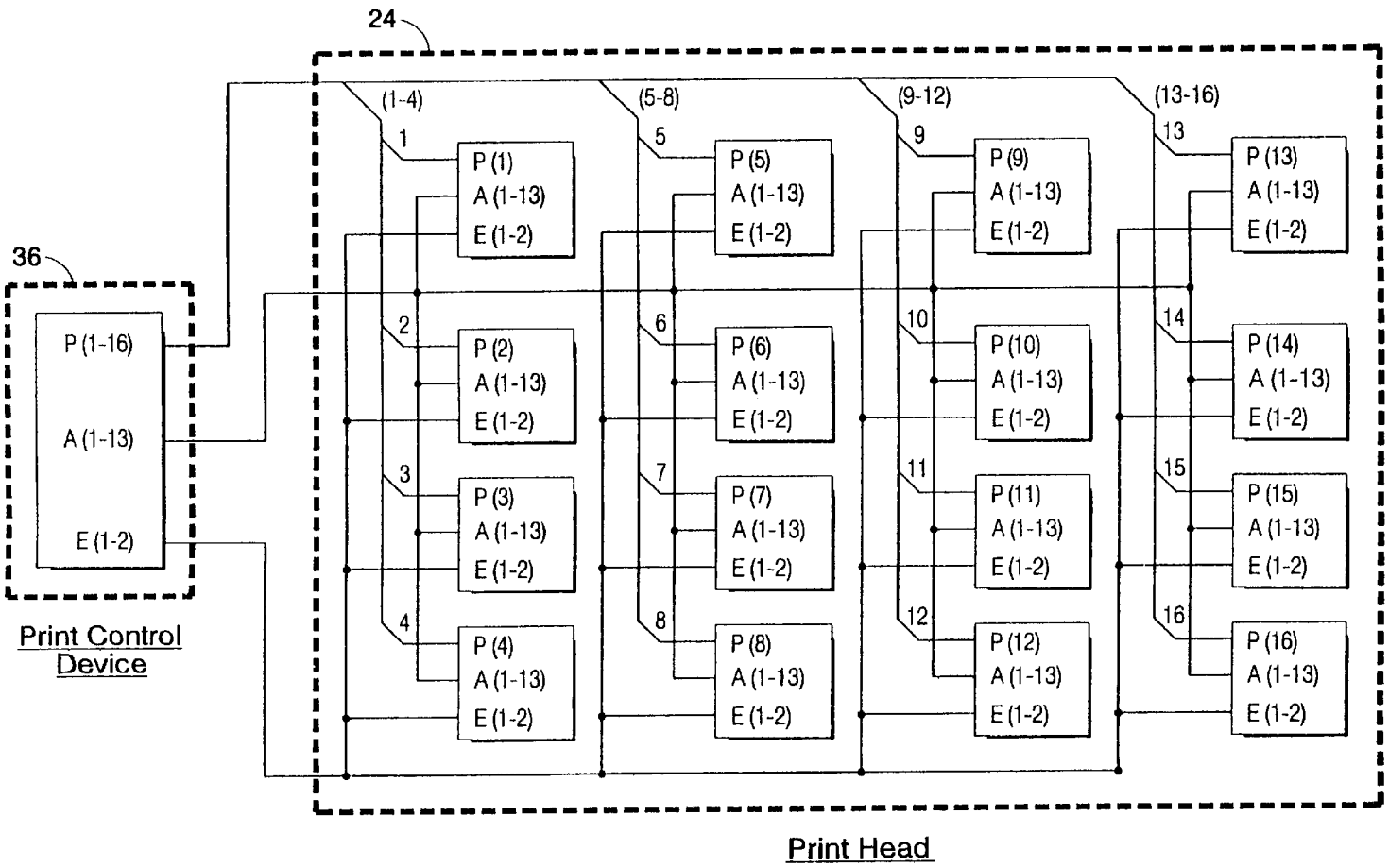
FIG. 4 is a block diagram showing further detail of one preferred embodiment of a print control device associated with the printer portion and the printhead shown with 16 groups of drop generators.

FIG. 4 depicts a simplified electrical block diagram showing greater detail of the print control device 36 within the printer portion 12 and the printhead 24 within the print cartridge 16. The print control device 36 includes a source of drive current, an address generator, and an enable generator. The source of drive current, address generator and enable generator provide drive current, address and enable signals under control of the control device or controller 36 to the printhead 24 for selectively activating each of a plurality of drop generators associated therewith.

In the preferred embodiment, the source of drive current provides 16 separate drive current signals designated P (1–16). Each drive current signal provides sufficient energy per unit time to activate the drop generator to eject ink. In the preferred embodiment, the address generator provides 13 separate address signals designated A(1–13) for selecting a group of drop generators. In this preferred embodiment the address signals are logic signals. Finally, in the preferred embodiment, the enable generator provides 2 enable signals designated E (1–2) for selecting a subgroup of drop generators from the selected group of drop generators. The selected subgroup of drop generators are activated if drive current provided by the source of drive current is supplied. Further detail of the drive signals, address signals and enable signals will be discussed with respect to FIGS. 9–11.

The printhead 24 shown in FIG. 4 includes a plurality of groups of drop generators with each group of drop generators connected to a different source of drive current. In the preferred embodiment, the printhead 24 includes 16 groups of drop generators. The first group of drop generators is connected to the source of drive current labeled P(1), the second group of drop generators are each connected to the source of drive current designated P(2), the third group of drop generators is connected to the source of drive current designated P(3), and so on with the sixteenth group of drop generators each connected to the source of drive current designated P(16).

Each of the groups of drop generators shown in FIG. 4 are connected to each of the address signals designated A(1–13) provided by the address generator on the print control device 36. In addition, each of the groups of drop generators are connected to the two enable signals designated E(1–2) provided by the address generator on the print control device 36. Greater detail of each of the individual groups of drop generators designated will now be discussed with respect to FIG. 5.

Figure 5:
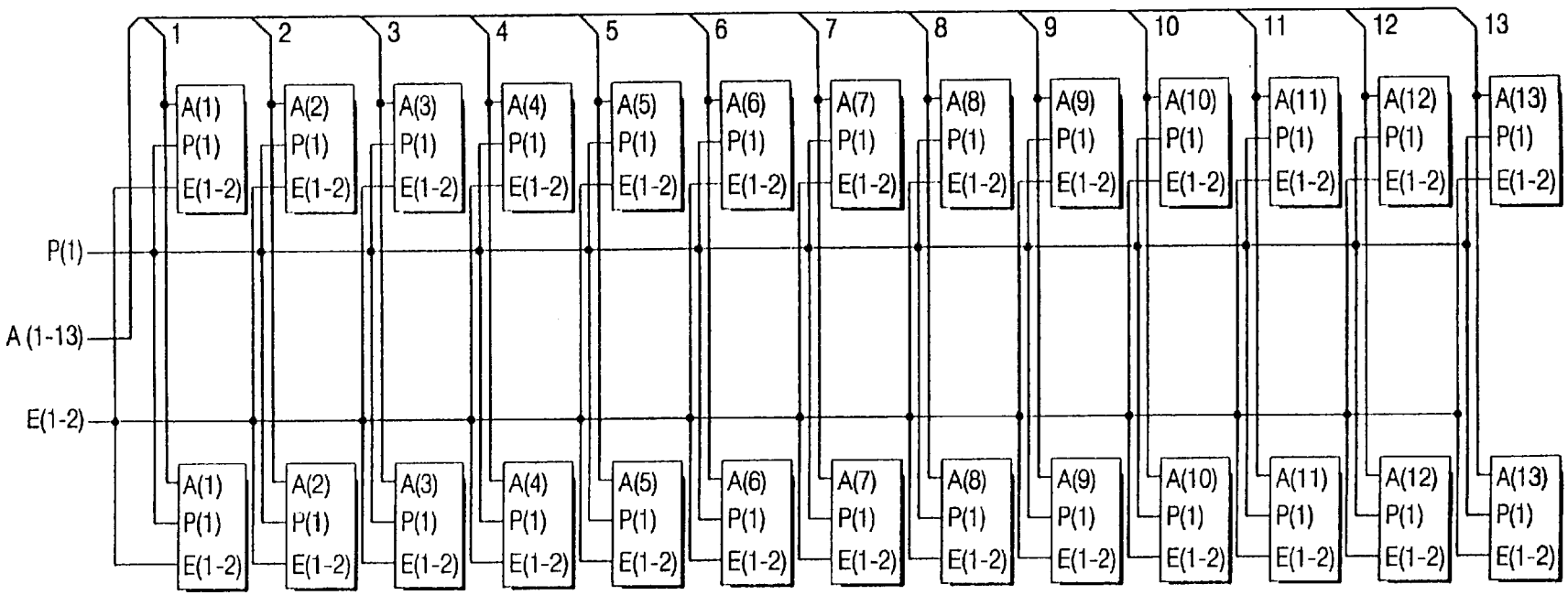
FIG. 5 is a block diagram showing further detail of one group of drop generators having 26 individual drop generators.

FIG. 5 is a block diagram representing a single group of drop generators from the plurality of groups of drop generators shown in FIG. 4. In the preferred embodiment, the single group of drop generators shown in FIG. 5 is a group of 26 individual drop generators each connected to a common source of drive current. The group of drop generators shown in FIG. 5 are all connected to the common source of drive current designated P(1) of FIG. 4.

The individual drop generators within the group of drop generators are organized in drop generator pairs with each pair of drop generators connected to a different source of address signals. For the embodiment shown in FIG. 5, the first pair of drop generators are connected to a source of address signals designated A(1), the second pair of drop generators are connected to a second source of address signals designated A(2), the third pair of drop generators are connected to a source of address signals designated A(3) and so on with the thirteenth pair of drop generators connected to the thirteenth source of address signals designated A(13).

Each of the 26 individual drop generators shown in FIG. 5 are also connected to the source of enable signals. In the preferred embodiment, the source of enable signals is a pair of enable signals designated E(1–2).

The remaining groups of drop generators shown in FIG. 4 that are connected to the remaining sources of drive current designated P(2) through P(16) are connected in a manner similar to the first group of drop generators shown in FIG. 5. Each of the remaining groups of drop generators are connected to a different source of drive current as designated in FIG. 4 instead of the source of drop current P(1) shown in FIG. 5. Greater detail of each individual drop generator shown in FIG. 5 will now be discussed with respect to FIG. 6.

Figure 6:
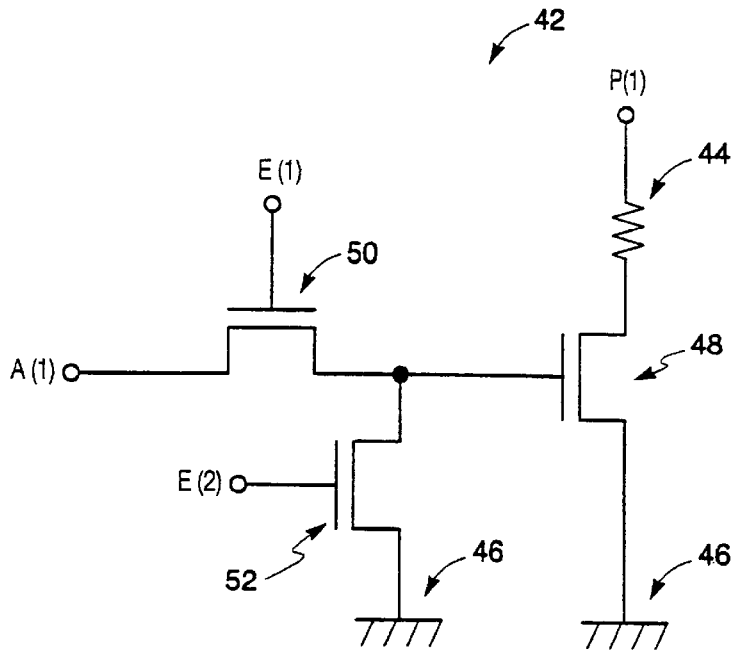
FIG. 6 is a schematic diagram showing further detail of one preferred embodiment of one individual drop generator of the present invention.
Figure 7:
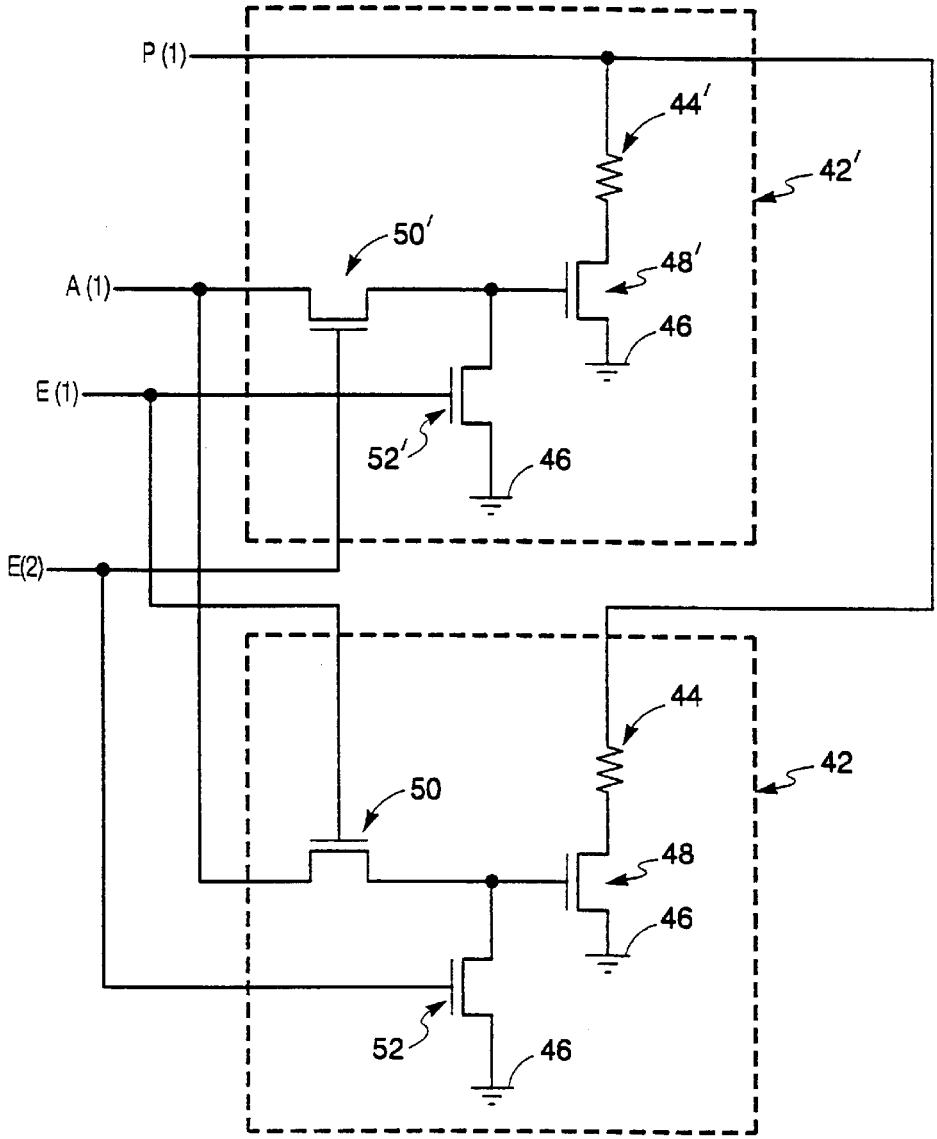
FIG. 7 is a schematic diagram showing two individual drop generators for the printhead of the present invention shown in FIG. 5.

FIG. 6 shows one preferred embodiment of an individual drop generator designated 42. The drop generator 42 represents one individual drop generator shown in FIG. 5. As shown in FIG. 5 two individual drop generators 42 make up a pair of drop generators 42 that are each connected to a common source of address signals. The individual drop generator shown in FIG. 6 represents one of the pair of drop generators 42 connected to address source I designated A(1) of FIG. 5. All sources of signals such as address signals A(1) and enable signals E(1–2) discussed with respect to FIGS. 6 and 7 are signals that are provided between the corresponding source of signals and the common reference point 46. In addition, the source of drive current is provided between the corresponding source of drive current designated P(1) and the common reference point 46.

The drop generator 42 includes a heating element 44 connected between the source of drive current. For the particular drop generator 42 shown in FIG. 6 the source of drive current is designated P(1). The heating element 44 is connected in series with a switching device 48 between the source of drive current P(1) and the common reference point 46. The switching device 48 includes a pair of controlled terminals connected between the heating element 44 and the common reference point 46. Also included with the switching device 48 is a control terminal for controlling the controlled terminals. The switching device 48 is responsive to activation signals at the control terminal for selectively allowing current to pass between the pair of controlled terminals. In this manner, activation of the control terminals allows drive current from the source of drive current designated P(1) to pass through the heating element 44 thereby producing heat energy that is sufficient to eject ink from the printhead 24.

In one preferred embodiment, the heating element 44 is a resistive heating element and the switching device 48 is a field effect transistor (FET) such as an NMOS transistor.

The drop generator 42 further includes a second switching device 50 and a third switching device 52 for controlling activation of the control terminal of the switching device 48. The second switching device has a pair of controlled terminals connected between a source of address signals and the control terminal of switching device 48. The third switching device 52 is connected between the control terminal of switching device 48 and the common reference point 46. Each of the second and third switching devices 50 and 52, respectively, selectively control the activation of the switching device 48.

The activation of switching device 48 is based on each of the address signal and enable signal. For the particular drop generator 42 shown in FIG. 6 the address signal is represented by A(1), the first enable signal represented by E(1) and a second enable signal represented by E(2). The first enable signal E(1) is connected to the control terminal of the second switching device 50. The second enable signal represented by E(2) is connected to the control terminal of the third switching device 52. By controlling the first and second enable signals, E(1–2), and the address signal, A(1), the switching device 48 is selectively activated to conduct current through the heating element 44 if drive current is present from the source of drive source P(1). Similarly, the switching device 48 is inactivated to prevent current from being conducted through the heating resistor 44 even if the source of drive current P(1) is active.

The switching device 48 is activated by the activation of the second switching device 50 and the presence of an active address signal at the source of address signals, A(1). In the preferred embodiment where the second switching device is a field effect transistor (FET) the controlled terminals associated with the second switching device are source and drain terminals. The drain terminal is connected to the source of address signals A(1) and the source terminal is connected to the controlled terminal of the first switching device 48. The control terminal for the FET transistor switching device 50 is a gate terminal. When the gate terminal, connected to the first enable signal E(1), is sufficiently positive relative to the source terminal and the source of address signals, A(1), provides a voltage at the drain terminal that is greater than the voltage at the source terminal then the second switching device 50 is activated.

The second switching device, if active, provides current from the source of address signals A(1) to the control terminal or gate of the switching device 48. This current, if sufficient, activates the switching device 48. The switching device 48, in the preferred embodiment, is a FET transistor having a drain and source as the controlled terminals with the drain connected to the heating element 44 and the source connected to the common reference terminal 46.

In the preferred embodiment, the switching device 48 has a gate capacitance between the gate and source terminals. Because this switching device 48 is relatively large to conduct relatively large currents through the heating device 44, then the gate to source capacitance associated with the switching device 48 tends to be relatively large. Therefore, to enable or activate the switching device 48, the gate or control terminal must be charged sufficiently so that the switching device 48 is activated to conduct between the source and drain. The control terminal is charged by the source of address signals A(1) if the second switching device 50 is active. The source of address signals A(1) provides current to charge the gate to source capacitance of the switching device 48. It is important that the third switching device 52 be inactive when the switching device 48 is active to prevent a low resistance path from being formed between the source of address signals A(1) and the common reference terminal 46. Therefore, the enable signal E(2) is inactive while the switching device 48 is active or conducting.

The switching device 48 is inactivated by activating the third switching device 52 to reduce the gate to source voltage sufficiently to inactivate the switching device 48. The third switching device 52 in the preferred embodiment is a FET transistor having drain and source as the controlled terminals with the drain connected to the control terminal of switching device 48. The control terminal is a gate terminal that is connected to the second source of enable signals E(2). The third switching device 52 is activated by activation of the second enable signal E(2) that provides a voltage at the gate that is sufficiently large relative to a voltage at the source of the third switching device 52. Activation of the third switching device 52 causes the controlled terminals or drain and source terminals to conduct thereby reducing a voltage between the control terminal or gate terminal of the switching device 48 and the source terminal of the switching device 48. By sufficiently reducing the voltage between the gate terminal and the source terminal of the switching device 48 the switching device 48 is prevented from being partially turned on by capacitive coupling.

While the third switching device 52 is active, the second switching 50 is inactive to prevent sinking large amounts of current from the source of address signals, A(1), to the common reference terminal 46. The operation of the individual drop generator 42 will be discussed in more detail with respect to the timing diagrams shown in FIGS. 8 through 11.

FIG. 7 shows greater detail of a pair of drop generators that are formed by the drop generator designated 42 and a drop generator designated 42'. Each of the drop generators 42 and 42' that form the pair of drop generators are identical to the drop generator 42 discussed previously with respect to FIG. 6. The pair of drop generators are each connected to a source of address signals represented by A(1) shown in FIG. 5. Each of the drop generators 42 and 42' are connected to a common source of drive current P(1) and common source of address signals A(1). However, the first and second enable signals E(1) and E(2), respectively, are connected differently in drop generator 42' from drop generator 42. In drop generator 42', the first enable signal E(1) is connected to the gate or control terminal of the third switching device 52' in contrast to drop generator 42 in which the first enable signal gate or control terminal of the second switching device 50. Similarly, the second enable signal E(2) is connected to the gate or control terminal of the second switching device 50' in the drop generator 42' in contrast to the drop generator 42 where the second enable signal E(2) is connected to the gate or control terminal of the third switching device 52.

The connection of the first and second enable signals E1 and E2 for the pair of drop generators 42 and 42' ensures that only a single drop generator of the pair of drop generators will be activated at a given time. As will be discussed later, it is important that within the group of drop generators that are connected to a common source of drive current that no more than one of these drop generators is active at the same time. The drop generators that are connected to a common source of drive current tend to be positioned near each other on the printhead. Therefore, by ensuring that no more than one of the drop generators that are connected to a common source of drive current of these is active at the same time tends to prevent fluidic crosstalk between these proximately positioned drop generators.

In the preferred embodiment, each of the pairs of drop generators shown in FIG. 5 are connected in a manner similar to the pair of drop generators shown in FIG. 7. In addition, each of the groups of drop generators connected to a common source of drive current shown in FIG. 4 are connected in a manner similar to the group of drop generators shown in FIG. 5.

Figure 8:
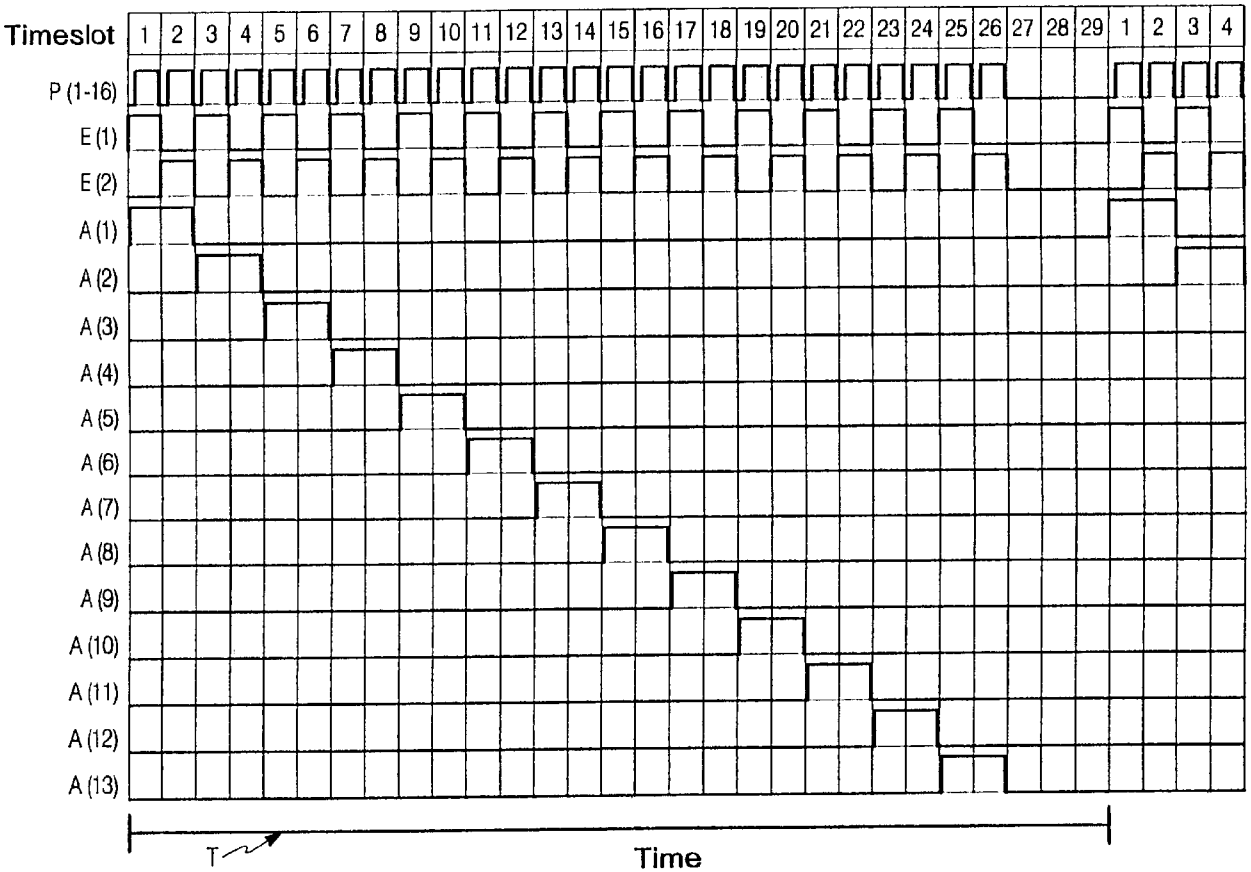
FIG. 8 is a timing diagram for operating the printhead of the present invention shown in FIG. 4.

FIG. 8 is a timing diagram illustrating the operation of printhead 24. The printhead 24 has a cycle time or period of time in which each of the drop generators on the printhead 24 can be activated. This period of time is represented by a time T shown in FIG. 8. The time T can be divided into 29 internals of time with each interval having the same duration. These intervals of time are presented by time slots 1 through 29. Each of the first 26 time slots represents a period in which a group of drop generators can be activated if the image to be printed so requires. Time slots 27, 28 and 29 represent intervals of time during a printhead cycle in which no drop generators are activated. The time slots 27, 28, and 29 are used by the printing system 10 to perform a variety of functions such as resynchronize the carriage 18 position and drop generator activation data and transfer activation data from the printer portion 12 to the printhead 24, to name a couple.

The 13 different sources of address signals represented by A(1) through A(13) are each shown. In addition, each of the first and second enable signals represented by E(1) and E(2) are also shown. Finally, each of the sources of drive current P (1–16) are also shown, grouped together. It can be seen from FIG. 8 that the address signals are each activated periodically with the period of activation for each address signal being equal to the cycle time T of the printhead 24. In addition, no more than one address signal is active at the same time. Each address signal is active during two consecutive time slots.

Each of the enable signals E(1) and E(2) are periodic signals having a period that is equal to two time slots. The enable signals E(1) and E(2) each have a duty cycle that is less than or equal to 50%. Each of the enable signals are out of phase with each other so that only one of enable signal E(1) or E(2) are active at the same time.

In operation, repeating patterns of address signals provided by each of the 13 sources of address signals A(1–13) are provided to the printhead 24 by the print control device 36. In addition, repeating patterns of enable signals for the first and second enable signals, E(1) and E(2), respectively, are also provided by the print control device 36 to the printhead 24. Both the address and enable signals are generated independent of the image description or image to be printed. Each of the 16 sources of drive current designated P(1–16) are selectively provided during each of the 26 time slots for each complete cycle for the inkjet printhead 24. The source of drive current P(1–16) is selectively applied based on the image description or the image to be printed. During the first time slot, the sources of drive current P(1–16) may all be active, none of them active or any number of them active, depending upon the image to be printed. Similarly, for time slots 2–26, each of the sources of drive current P(1–16) are individually selectively activated as required by the print control device 36 to form the image to be printed.

Figure 9:
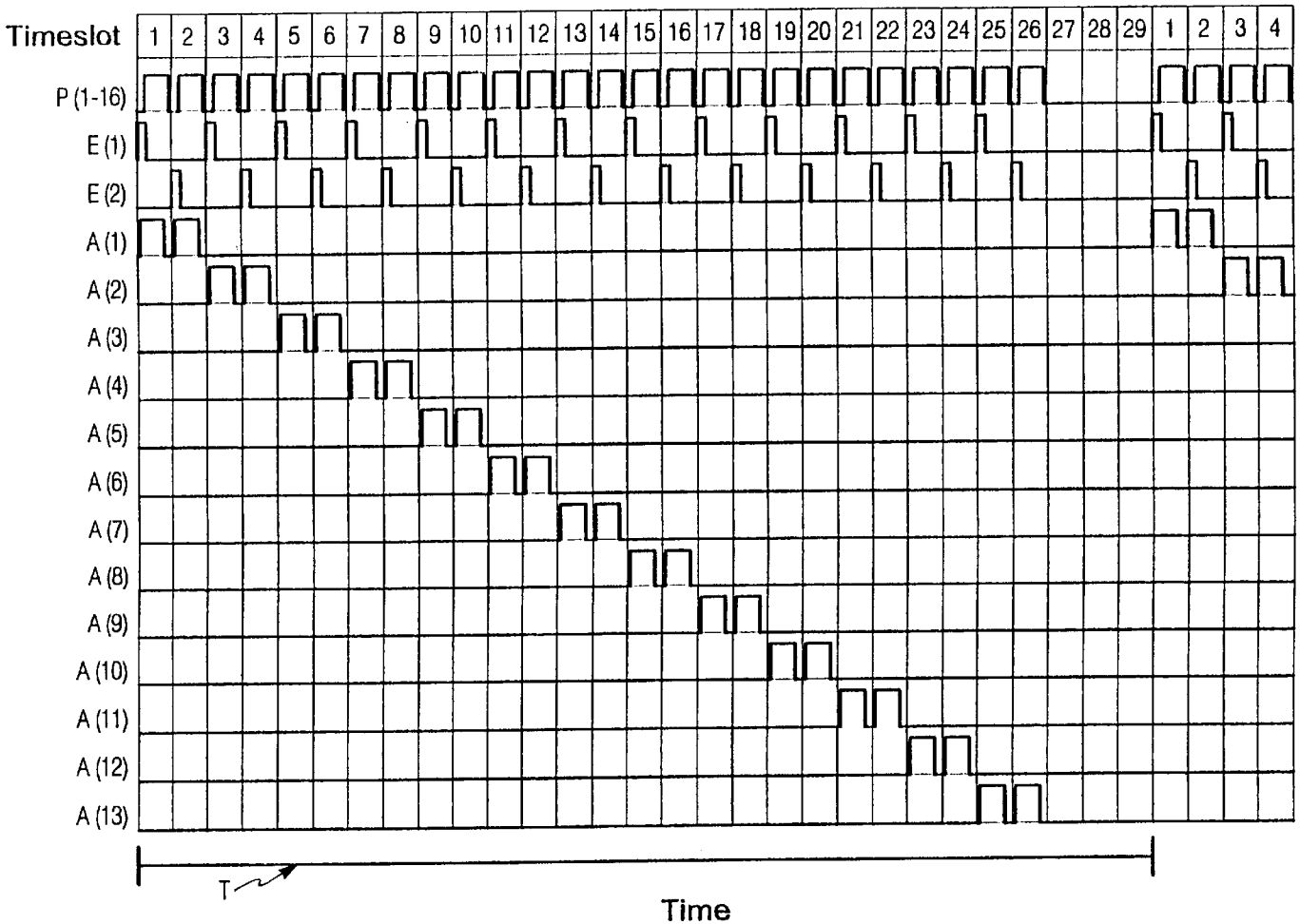
FIG. 9 is an alternative timing diagram for operating the printhead of the present invention shown in FIG. 4.

FIG. 9 is a preferred timing diagram for each of the sources of drive current P(1–16), sources of address signals A(1–13) and enable signals E(1–2) for the printhead 24 of the present invention. The timing in FIG. 9 is similar to the timing of FIG. 8 except that each source of address signals A(1–13) instead of remaining active over the entire two consecutive time slots shown in FIG. 8, each address is active for only a portion of each of the two time slots shown in FIG. 9. In this preferred embodiment, each of the address signals A(1–13) are active at the beginning of each time slot the address signal is active. In addition, the duty cycle of each of the first and second enable signals reduced from the nearly 50% duty cycle shown in FIG. 8. Further detail of the timing of the address enable and drive current will now be discussed with respect to FIGS. 10 and 11.

Figure 10:
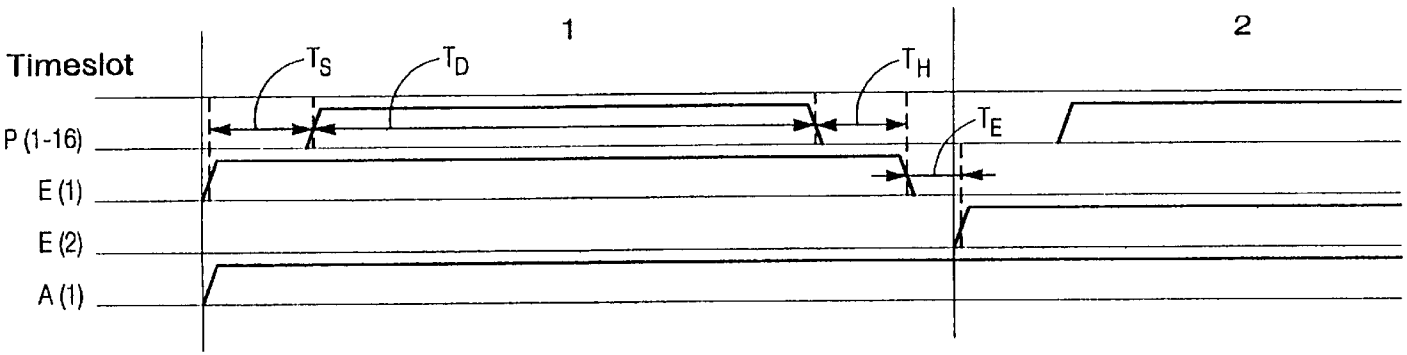
FIG. 10 is a detailed view of the timing for timeslots 1 and 2 of the timing diagram shown in FIG. 8.

FIG. 10 shows greater detail of time slots 1 and 2 for the timing diagram of described in FIG. 8. Because the only active address signal during time slot 1 and 2 is A(1) only the address signal A(1) need be shown in FIG. 10. As discussed previously, it is important that the first and second enable signals, E(1) and E(2) respectively, not be active at the same time to prevent providing a low resistance path to the common reference point 46 thereby sinking current from the source of address signals A(1–13). Therefore, the duty cycle of each of the first and second enable signals, E(1) and E(2) respectively, should be less than 50%. In FIG. 10 the time interval labeled TE between the transition from active to inactive for the first enable signal E(1) and the transition from inactive to active for the second enable signal E(2) should be greater than zero.

The enable signal should be active before drive current is provided by the source of drive current to ensure that the gate of capacitance of the switching transistor 48 is sufficiently charged to activate the drive transistor 48. The time interval labeled $T_S$ represents the time between the first enable E(1) active and the application of the drive current by the sources of drive current P(1–16). A similar time interval is required for the time between the second enable E(2) active and the application of the drive current by the sources of drive current P(1–16).

The enable signal E(1) should remain active for a period of time after the source of drive current P(1–16) transitions from active to inactive as designated $T_H$. This period of time $T_H$ referred to as hold time is sufficient to ensure that drive current is not present at the switching device 48 when the switching device 48 is inactivated. Inactivating the switching device 48 while the switching device 48 is conducting current between the controlled terminals can damage the switching device 48. The hold time $T_H$ provides margin to ensure the switching device 48 is not damaged. The duration of the drive current signal P(1–16) is represented by time interval labeled TD. The duration of drive current signal P(1–16) is selected to be sufficient to provide drive energy to the heating element 44 for optimum drop formation.

Figure 11:
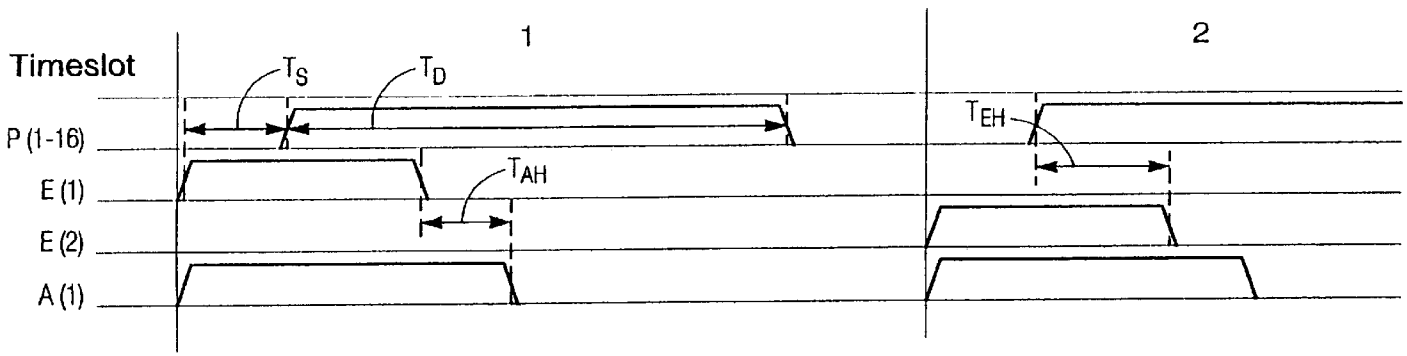
FIG. 11 is a detailed view of the timing for timeslots 1 and 2 of the alternative timing diagram shown in FIG. 9.

FIG. 11 shows further detail of the preferred timing for time slots 1 and 2 for the timing diagram of FIG. 9. As shown in FIG. 11 for time slot 1 the source of address signals A(1) and the source of enable signals E(1) do not remain active the entire duration that the source of drive current remains active. Once the gate capacitance of the switching transistor 48 and 48' shown in FIG. 7 is charged, the transistor 48 and 48' remain conducting the remaining duration that the source of drive current remains active. In this manner, the gate capacitance of the switching device 48 and 48' acts as a storage device or memory device that retains an activated state. The switching device 48 and 48' are selected to have sufficient capacitance so that charge stored within this capacitance remains beyond a threshold amount to keep the switching device 48 and 48' conducting while the drive current signal is active. The source of drive signals designated P(1–16) then provides the drive energy that is necessary for optimum drop formation.

Similar to FIG. 10 the time interval labeled $T_S$ represents the time between the first enable E(1) active and the application of the drive current by the sources of drive current P(1–16). An interval of time labeled $T_{AH}$ represents a hold time the source of address signals A(1) must remain active after the first enable signal E(1) is inactive to ensure the gate capacitance for transistor 48' is in the proper state. If the source of address signals were to change state before the first enable signal E(1) signal becomes inactive the wrong state of charge can exist at the gate of transistors 48 and 48'. Therefore, it is important that the time interval labeled $T_{AH}$ be greater than 0. An interval of time labeled $T_{EH}$ represents a hold time the second enable signal E(2) must be active after the source of drive current P(1–16) becomes active. During the time interval transistor 52 in FIG. 7 is activated by the second enable signal E(2) to discharge the gate capacitance of transistor 48. If this duration is not sufficiently long to discharge the gate of transistor 48 the heating element 44 may improperly be activated or partially activated.

Operation of the inkjet printhead 24 using the preferred timing shown FIG. 11 has important performance advantages over the use of the timing shown in FIG. 10. A minimum time required for each drop generator 42 activation for the timing shown in FIG. 10, is equal to the sum of time intervals $T_S$, $T_D$, $T_E$ and $T_H$. In contrast, the timing shown in FIG. 11 has a minimum time that is required for each drop generator 42 activation that is equal to the sum of time intervals $T_S$, and $T_D$. Because $T_D$ and $T_S$ is the same for each of the timing diagrams, the minimum time required for activation of a drop generator 42 is less in FIG. 11 than in FIG. 10. Both the address hold time $T_{AH}$ and the enable hold time $T_{EH}$ do not contribute to the minimum time interval for drop generator 42 activation in the preferred timing shown in FIG. 11 thereby allowing each time slot to be a smaller time interval than in FIG. 10. Reduction of the time interval required for each time slot reduces the cycle period designated T in FIGS. 8 and 9 thereby increasing the printing rate for the printhead 24.

The method and apparatus of the present invention allows 416 individual drop generators to be individually activated using 13 address signals, two enable signals, and 16 sources of drive current. In contrast, the use of previously used techniques whereby an array of drop generators having 16 columns and 26 rows would require 26 individual addresses to individually select each row with each column being selected by each source of drive current. The present invention provides significantly fewer electrical interconnects to address the same number of drop generators. The reduction of electrical interconnects reduces the size of the printhead 24 thereby significantly reducing the costs of the printhead 24.

Each individual drop generator 42 as shown in FIG. 6 does not require a constant power supply or bias circuit but instead relies on the input signals such as address, source of drive current, and enable signals to supply power or activate the drop generator 42. As discussed previously with respect to the timing of the signals, it is important that these signals be applied in the proper sequence in order to have proper operation of the drop generator 42. Because the drop generator 42 of the present invention does not require constant power, the drop generator 42 can be implemented in relatively simple technology such as NMOS which requires fewer manufacturing steps then more complex technology such as CMOS. Use of a technology that has lower manufacturing costs further reduces the costs of the printhead 24. Finally, the use of fewer electrical interconnects between the printer portion 36 and the printhead 24 tends to reduce the costs of the printer portion 36 as well as increase the reliability of the printing system 10.

Although the present invention has been described in terms of a preferred embodiment that makes use of 13 address signals, two enable signals, and 16 sources of drive current to selectively activate 416 individual drop generators other arrangements are also contemplated. For example, the present invention is suitable for selectively activating different numbers of individual drop generators. The selective activation of different numbers of individual nozzles may require different numbers of one or more of the address signals, enable signals, and sources of drive current to properly control different numbers of drop generators. In addition, there are other arrangements of address signals, enable signals; and sources of drive current to control the same number of drop generators as well.

What is claimed is:

1. An inkjet printing device for use with an inkjet printhead for forming images on media in response to image descriptions, the inkjet printing device comprising:

a printhead control portion for providing address signals for identifying a first set of drop ejection devices on the inkjet printhead, the printhead control portion providing enable signals for identifying a subset of drop ejection devices from the set of drop ejection devices, the printhead control portion providing drive current to selected drop ejection devices on the inkjet printhead; and wherein the printing device provides periodic patterns of address and enable signals to A address contacts and E enable contacts and wherein the printing device selectively applies drive current in response to image descriptions to D drive current contacts and wherein only drop ejection devices within the identified subset that are provided drive current are activated to eject ink, wherein the printing device controls an array of (A×E×D) drop ejection devices on the ink printhead by providing the periodic patterns of address and enable signals and selectively applying the drive current.

2. The inkjet printing device of claim 1 wherein the inkjet printing device is an inkjet printer.

3. The inkjet printing device of claim 1 wherein the wherein the printing device is configured to provide relative movement between the inkjet printhead and the media as the printhead is selectively activated to deposit ink on the media.

4. The inkjet printing device of claim 1 wherein the inkjet printing device is configured to receive a print cartridge, the print cartridge having a plurality of electrical contacts so disposed and arranged on the print cartridge to engage and operably couple with corresponding electrical contacts on the printing device and wherein the print cartridge includes an inkjet printhead electrically connected to the plurality of electrical contacts.

5. The inkjet printing device of claim 1 wherein A is equal to thirteen, E is equal to two, and D is equal to sixteen.

6. The inkjet printing device of claim 1 wherein A×E×D is equal to 416.

7. The inkjet printing device of claim 1 wherein a ratio A/E is approximately 6.5/1.

8. An inkjet printing system comprising:

an inkjet printhead having drop generators and a plurality of electrical contacts, the plurality of electrical contacts including address contacts, enable contacts, and drive current contacts;

a printing device having a plurality of electrical contacts including A address contacts, E enable contracts and D drive current contacts, the plurality of electrical contacts configured to establish electrical contact with corresponding electrical contacts on the inkjet printhead upon insertion of the inkjet printhead into the printing device;

wherein the printing device provides periodic address signals to the address contacts and periodic enable signals to the enable contacts and wherein the printing device selectively applies drive current based on image descriptions to the drive current contacts;

wherein the printhead is responsive to periodic signaling from each of the address and enable signals and wherein the printhead is responsive to the selective application of drive current to selectively eject ink from the inkjet printhead to form images on print media; and wherein the printhead includes an array of (A×E×D) drop generators controlled by the A address contacts, the E enable contacts, and the D drive current contacts.

9. The inkjet printing system of claim 8 wherein the printing device is configured to provide relative movement between the inkjet printhead and the print media as the printhead is selectively activated to deposit ink on the print media.

10. The inkjet printing system of claim 8 wherein the address signals identify a first set of drop generators on the inkjet printhead, wherein the enable signals identify a subset of drop generators from the set of drop generators, and wherein only drop generators within the identified subset that are provided drive current are activated to eject ink.

11. The inkjet printing system of claim 8 wherein the drop generators are organized in a plurality of groups of drop generators with each of the plurality of groups of drop generators connected to a different drive current contact and wherein each of the plurality of groups of drop generators includes subgroups of drop generators and each subgroup of drop generators within the group of drop generators is connected to a different address contact of the plurality of address contacts.

12. The inkjet printing system of claim 8 wherein A is equal to thirteen, E is equal to two, and D is equal to sixteen.

13. The inkjet printing system of claim 8 wherein A×E×D is equal to 416.

14. The inkjet printing system of claim 8 wherein a ratio A/E is approximately 6.5/1.

15. An inkjet printhead for use with an inkjet printing device for forming images on media, the inkjet printhead comprising:

drop generators;

a plurality of contacts configured to establish connection, upon insertion of the printhead into the printing device, with a corresponding plurality of contacts on the printing device, the plurality of contacts on the printhead including D drive current contacts, A address contacts, and E enable contacts respectively receiving, from the printing device, drive current, periodic address signals, and periodic enable signals;

wherein the printhead is responsive to periodic signaling from each of the address and enable signals and wherein the printhead is responsive to selective application of drive current based on image descriptions to selectively eject ink from the inkjet printhead; and wherein the printhead includes an array of (A×E×D) drop generators controlled by the A address contacts, the E enable contacts, and the D drive current contacts.

16. The inkjet printhead of claim 15 wherein the address signals identify a first set of drop generators on the inkjet printhead, wherein the enable signals identify a subset of drop generators from the set of drop generators, and wherein only drop generators within the identified subset that are provided drive current are activated to eject ink.

17. The inkjet printhead of claim 15 wherein the drop generators are organized in a plurality of groups of drop generators with each of the plurality of groups of drop generators connected to a different drive current contact and wherein each of the plurality of groups of drop generators includes subgroups of drop generators and each subgroup of drop generators within the group of drop generators is connected to a different address contact of the plurality of address contacts.

18. The inkjet printhead of claim 15 wherein A is equal to thirteen, E is equal to two, and D is equal to sixteen.

19. The inkjet printhead of claim 15 wherein A×E×D is equal to 416.

20. The inkjet printhead device of claim 15 wherein a ratio A/E is approximately 6.5/1.

* * * * *

UNITED STATES PATENT AND TRADEMARK OFFICE

CERTIFICATE OF CORRECTION

PATENT NO. : 6,698,857 B2
DATED : March 2, 2004
INVENTOR(S) : Torgerson et al.

It is certified that error appears in the above-identified patent and that said Letters Patent is hereby corrected as shown below:

Column 13,
Line 9, delete “ink” and inset in lieu thereof -- inkjet --.

Signed and Sealed this

Twenty-ninth Day of June, 2004

JON W. DUDAS
*Acting Director of the United States Patent and Trademark Office*